US009924273B2

(12) United States Patent
Jacobites et al.

(10) Patent No.: US 9,924,273 B2
(45) Date of Patent: Mar. 20, 2018

(54) ACOUSTIC DEVICE CONFIGURATION AND METHOD

(71) Applicant: BOSE CORPORATION, Framingham, MA (US)

(72) Inventors: Brock N. Jacobites, Westborough, MA (US); Timothy B. Stonelake, Cambridge, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/087,820

(22) Filed: Mar. 31, 2016

(65) Prior Publication Data

US 2017/0289692 A1 Oct. 5, 2017

(51) Int. Cl.

| | |
|---|---|
| ***H04R 1/00*** | (2006.01) |
| ***H04R 7/16*** | (2006.01) |
| ***H04R 31/00*** | (2006.01) |

(52) U.S. Cl.

CPC ..... *H04R 7/16* (2013.01); *H04R 31/003* (2013.01); *H04R 2307/201* (2013.01)

(58) Field of Classification Search

CPC ... H04R 7/16; H04R 31/003; H04R 2307/201
See application file for complete search history.

(56) References Cited

U.S. PATENT DOCUMENTS

| | | | |
|---|---|---|---|
| 6,044,925 | A | 4/2000 | Sahyoun |
| 6,160,898 | A | 12/2000 | Bachmann et al. |
| 6,457,548 | B1 | 10/2002 | D'Hoogh |
| 6,460,651 | B1 | 10/2002 | Sahyoun |
| 6,490,363 | B1 | 12/2002 | Liu |
| 6,626,263 | B2 | 9/2003 | Sahyoun |
| 6,658,129 | B2 | 12/2003 | D'Hoogh |
| 6,675,931 | B2 | 1/2004 | Sahyoun |
| 6,700,987 | B2 | 3/2004 | Kuze et al. |
| 7,318,496 | B2 | 1/2008 | Sahyoun |
| 7,418,107 | B2 | 8/2008 | Milot et al. |
| 7,428,946 | B2 | 9/2008 | Honda et al. |
| 8,019,112 | B2 | 9/2011 | Milot et al. |
| 8,073,186 | B2 | 12/2011 | Milot et al. |
| 2002/0051552 | A1 | 5/2002 | Schott |
| 2012/0002836 | A1 | 1/2012 | Milot et al. |
| 2013/0195311 | A1 | 8/2013 | Sahyoun |
| 2016/0118032 | A1* | 4/2016 | Kawka ..... G10K 11/002 181/171 |

FOREIGN PATENT DOCUMENTS

| | | | |
|---|---|---|---|
| CN | 201440722 | U | 4/2010 |
| JP | 4377243 | A | 9/2009 |
| JP | 4624468 | B2 | 2/2011 |

OTHER PUBLICATIONS

U.S. Application entitled "Acoustic Device Suspension".

* cited by examiner

*Primary Examiner* — Tuan D Nguyen
(74) *Attorney, Agent, or Firm* — Patterson + Sheridan, LLP

(57) ABSTRACT

A suspension element coupled to a diaphragm and to a frame of an acoustic device. The suspension element includes a first surround element and a second surround element that are located adjacent to each other. At least one of the surround elements includes at least one or more openings. The at least one or more openings have features of being located at an edge of the at least one of the surround elements adjacent to the other surround element, or being located in both of the surround elements.

9 Claims, 8 Drawing Sheets

ACOUSTIC DEVICE CONFIGURATION AND METHOD

I. FIELD OF THE DISCLOSURE

The present disclosure relates in general to an acoustic device, and more particularly, to a suspension element of an acoustic device.

II. BACKGROUND

A user of an acoustic device enjoys hearing sounds that are pleasant, crisp, and free of noise. Inherent design flaws in the acoustic device can contribute to undesirable sound heard by the user. An improperly designed suspension element of the acoustic device may contribute directly or indirectly to the undesirability of sound heard by the user.

III. SUMMARY

All examples and features mentioned below can be combined in any technically possible way.

In one aspect, an acoustic device includes a diaphragm, a frame, and a suspension element coupled to the diaphragm and to the frame. The diaphragm is movable in a reciprocating manner relative to the frame. According to a particular implementation, the suspension element includes a first surround element and a second surround element that are located adjacent to each other. At least one of the surround elements includes at least one or more openings. The at least one or more openings are configured to enable venting of an interior of the surround elements to an exterior of the surround elements.

According to a particular implementation, the at least one or more openings are located at an edge of the at least one of the surround elements adjacent to the other surround element. According to another particular implementation, the at least one or more openings are located in both of the surround elements.

In a particular implementation, a spacer is disposed between the first surround element and the second surround element, and the spacer is disposed between contacting parts of the surround elements. A number or placement of the openings is based on at least one of a particular acoustic impedance of the suspension element or a particular resonance effect of the acoustic device.

In another aspect, the acoustic device includes a spacer disposed between the first surround element and the second surround element. In a particular implementation, the spacer is disposed between the surround elements. For example, the spacer may be positioned between two openings defined by the first surround element and the second surround element.

In another example, a method includes forming a first surround element and forming a second surround element. At least one of the surround elements includes at least one or more openings that are located at an edge of the at least one of the surround elements. According to a particular implementation, forming the at least one of the surround elements is based on a particular acoustic impedance of the at least one of the surround elements adjacent to the other surround element. According to another particular implementation, forming the at least one of the surround elements is based on a particular resonance effect of an acoustic device.

In an implementation, the method includes coupling the first surround element with the second surround element. According to a particular implementation, coupling the first surround element with the second surround element includes coupling a spacer between the first surround element and the second surround element.

In another aspect, each of the first surround element and the second surround element include one or more openings that are located at edges of the respective surround element. According to a particular implementation, coupling the first surround element with the second surround element includes aligning the one or more openings of the first surround element with the one or more openings of the second surround element. According to another particular implementation, coupling the first surround element with the second surround element includes offsetting the one or more openings of the first surround element relative to the one or more openings of the second surround element.

IV. BRIEF DESCRIPTION OF THE DRAWINGS

V. DETAILED DESCRIPTION

A suspension element used in an acoustic device is disclosed. The suspension element includes one or more surround elements. At least one surround element (of the suspension element) is designed or formed to include ventilation (e.g., an opening or a hole) for the suspension element. Forming the ventilation into a surround element improves manufacturability of the acoustic device by eliminating an additional component for venting. Further, forming the ventilation into the surround element simplifies time and complexity during the attachment process of the suspension element to the acoustic device as compared to an acoustic device that does not have a surround element that supports ventilation.

Tunable venting for dynamic operation of the surround elements is achieved based on a particular geometry of the openings. The particular geometry of the openings is associated with one or more characteristics of at least one of the surround elements, the suspension element, or the acoustic device. The one or more characteristics may be associated with acoustic impedance or resonance effect. Acoustic impedance considerations may include a size of vents based on flow noise, resonances, and open area vs. enclosed volume, among other factors. Improperly formed openings may create a ticking, buzzing, whistling, or other objectionable noise. The suspension element may be formed using a direct form geometry approach for venting, where openings for venting are based on a particular acoustic impedance or resonance effect to be achieved for the acoustic device.

Figure 1:
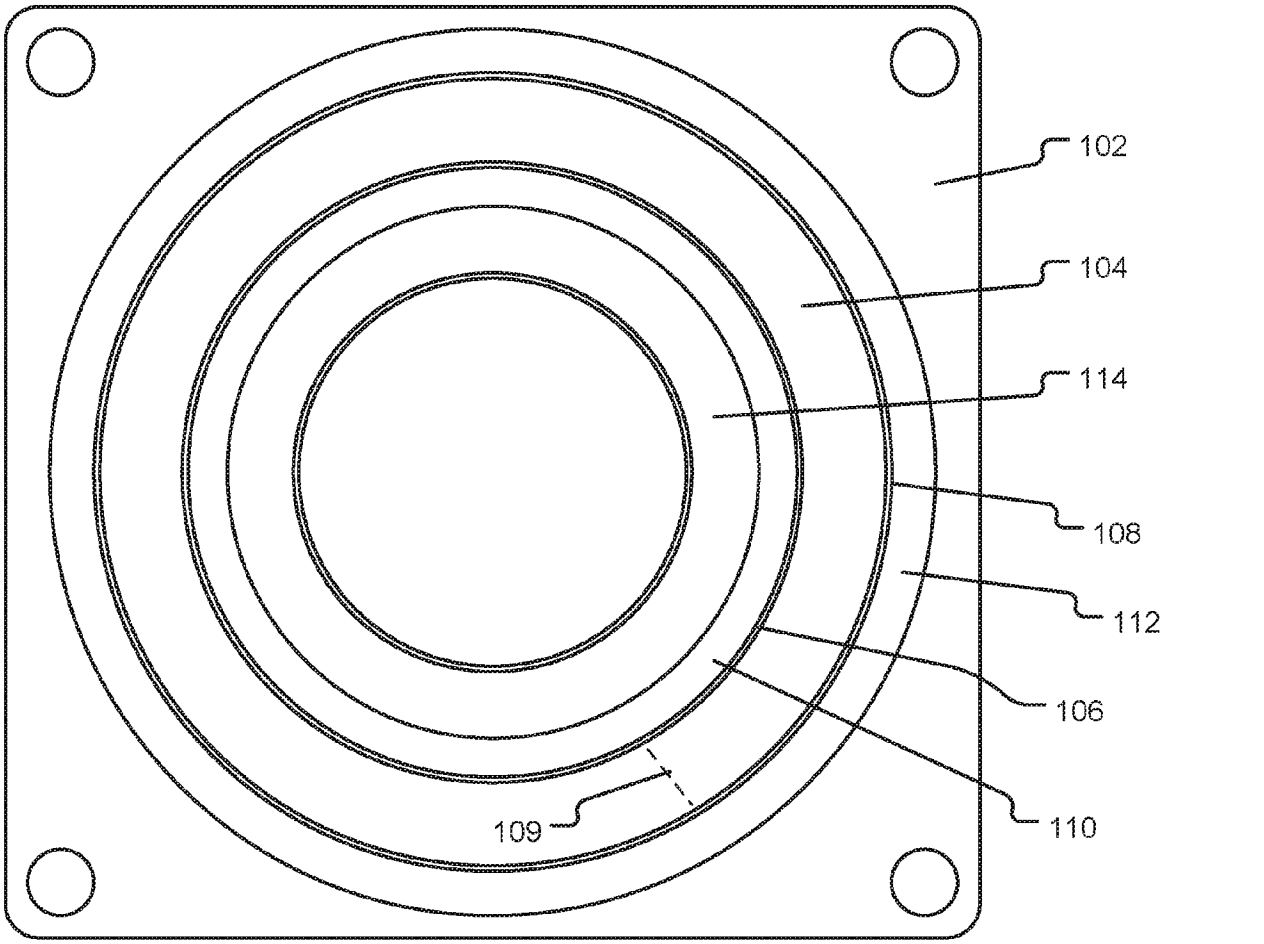
FIG. 1 is a top view of an exemplary acoustic device with a suspension element.

Turning to FIG. 1, a top view of an exemplary acoustic device 100 is shown. The acoustic device 100 includes a suspension element 104 coupled to a diaphragm 114 and to a frame 102. The diaphragm 114 is movable in a reciprocating manner relative to the frame 102. The suspension element 104 is formed by a pair of opposing surround elements each having an inner edge 106 and an outer edge 108. The inner edge 106 and the outer edge 108 are separated by a radial width 109, or span. The suspension element 104 includes an inner landing 110 (extending radially inward from the inner edge 106), and an outer landing 112 (extending radially outward from the outer edge 108) for connection to the diaphragm 114 and the frame 102, respectively. Handling and flatness of the suspension element 104 are improved by increasing beam thickness of the outer landing 112. The beam thickness may be increased for one or both outer landings of the suspension element 104.

The suspension element 104 is be coupled to the diaphragm 114 and to the frame 102 using any suitable method, including, but not limited to, use of an adhesive or by melting material of the suspension element 104 to the diaphragm 114 and the frame 102. The suspension element 104 is be made from any suitable material, including, but not limited to, fabric, rubber, foam, metal, polymer, polyurethane plastic, such as thermoplastic polyurethane, or a composite thereof. In some implementations, the suspension element 104 includes rib and groove features (not shown) which may enhance axial stiffness, free length, force-deflection relationships, and buckling resistance.

Figure 2:
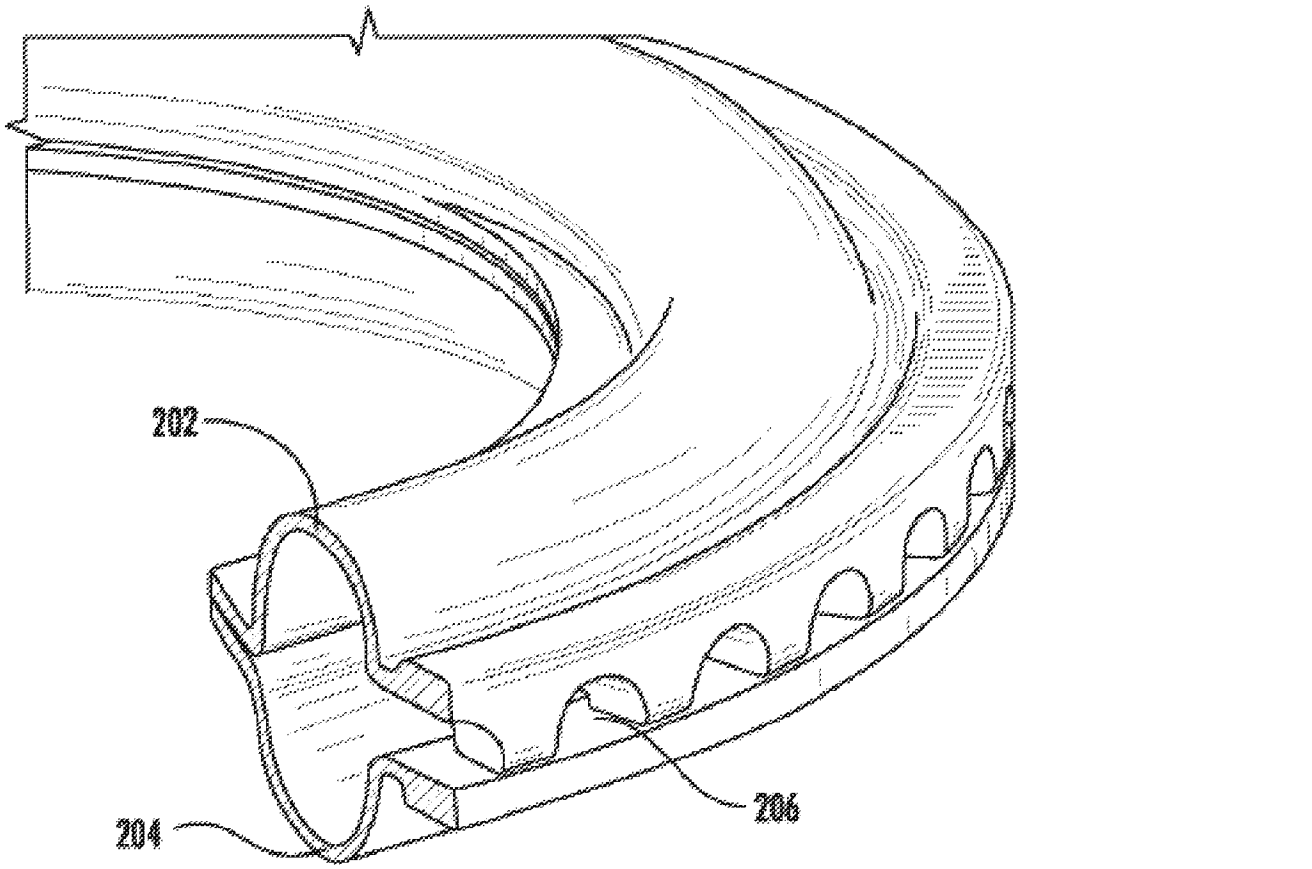
FIG. 2 is a sectional view of an exemplary implementation of a suspension element including a surround element having openings for venting.

FIG. 2 depicts a sectional view of an exemplary implementation of a suspension element 200 having a first surround element that includes openings for venting. The suspension element 200 may be the suspension element 104 of FIG. 1. The suspension element 200 includes a first surround element 202 and a second surround element 204. At least one of the surround elements 202, 204 is made from at least one of fabric, rubber, foam, metal, polymer, polyurethane plastic, such as thermoplastic polyurethane, or a composite thereof.

The first surround element 202 includes one or more openings 206 (e.g., one or more features, such as one or more grooves) located at an edge of the first surround element 202. The openings 206 are configured to enable ventilation of an interior (e.g., an interior environment) of the surround elements 202, 204. As shown in FIG. 2, the openings 206 are formed into the first surround element 202. Alternatively, the openings 206 are formed into the second surround element 204, instead of the first surround element 202. In another example, the openings may be included in both surround elements 202, 204. The openings 206 correspond to any shape or geometry that conserves a specific cross-sectional area or provides for a desired fluid flow behavior. For instance, the openings 206 may correspond to a semicircle or a revolved hyperbola. In an example, the revolved hyperbola is a turned 3D hyperbola or a hyperbolic paraboloid.

According to an implementation, the one or more openings 206 are based on a particular acoustic impedance of the suspension element 200. In another example, the openings 206 are based on a particular resonance effect of an acoustic device. The acoustic device may correspond to the acoustic device 100 of FIG. 1. The particular acoustic impedance or the particular resonance effect is based on a size of the openings 206. In one aspect, the size of the openings is based on an area of the openings 206 in relation to (e.g., as a percentage of) an area of the suspension element 200. The size of the openings 206, or vents, of an implementation may additionally or alternatively be based on the volume of air between the surround elements 202, 204, or may correspond to the resonant effect of the openings (or may be based on the glue area needed between the surround elements 202, 204). The area of the suspension element 200 may be a surface area of the suspension element 200.

Each of the surround elements 202, 204 may be formed via compression molding, injection molding, or thermal forming. One or both of the surround elements 202, 204 may be made from porous material. The material of the surround elements 202, 204 may be initially dense and very porous. Subsequently, the surround elements 202, 204 may be compressed to lower the porosity of the material.

In some implementations, the first surround element 202 is coupled to the second surround element 204. For example, the first surround element 202 is coupled (connected or otherwise bonded) to the second surround element 204 by an adhesive material, such as glue, or by fusing (e.g., melting) the first surround element 202 to the second surround element 204. While coupled, an interior chamber (associated with a volume of air) is defined by at least the first surround element 202 and the second surround element 204 define. Additionally, while coupled, the first surround element 202 and the second surround element 204 form the suspension element 200 (e.g., a single structure) having one or more openings, such as a representative opening 206 depicted in FIG. 2. A particular opening of the one or more openings defined by a first surface of the first surround element 202 and a second surface of the second surround element 204. At least one opening of the one or more openings enables airflow from the interior chamber to an outside environment. Additionally or alternatively, the at least one opening enables airflow from the outside environment, via the at least one opening, to the interior chamber.

Figure 3:
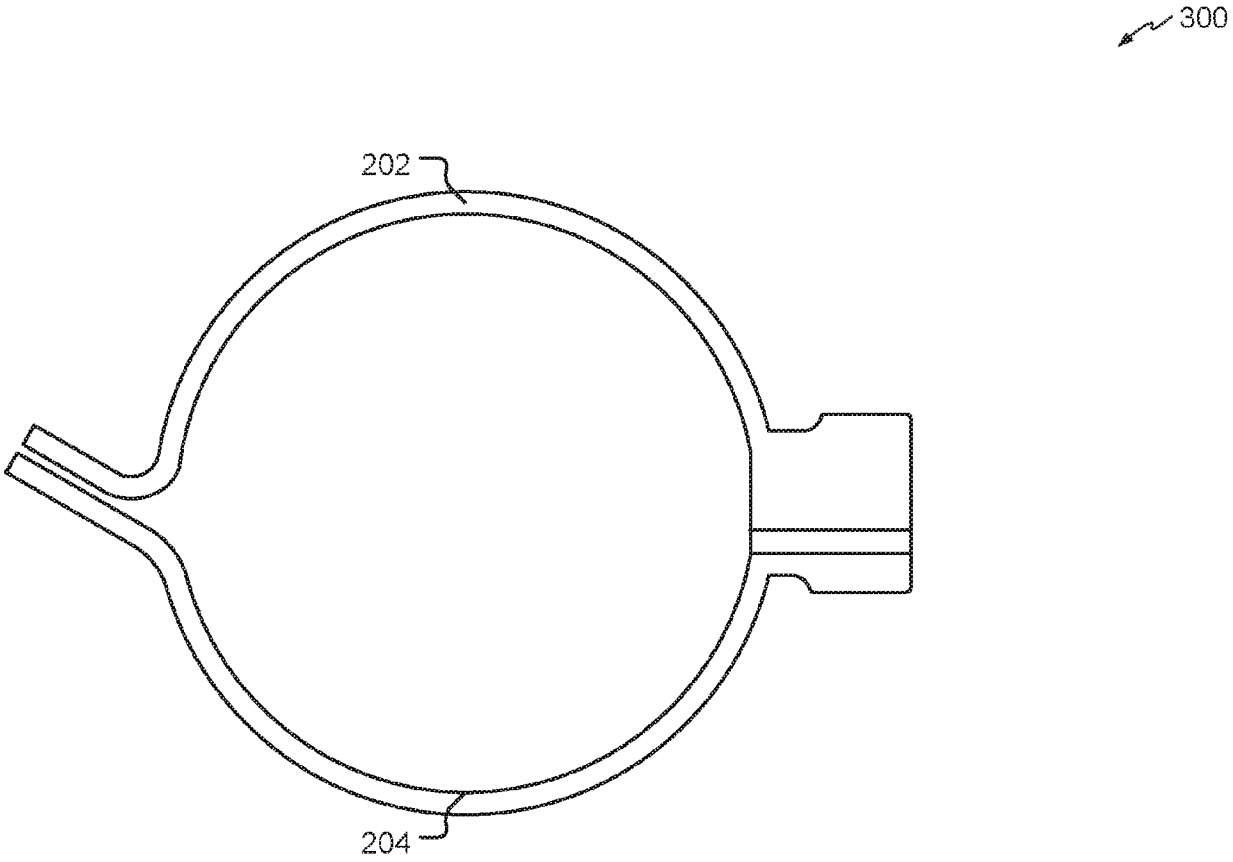
FIG. 3 is a cross-sectional view of the suspension element shown in FIG. 2.
Figure 4:
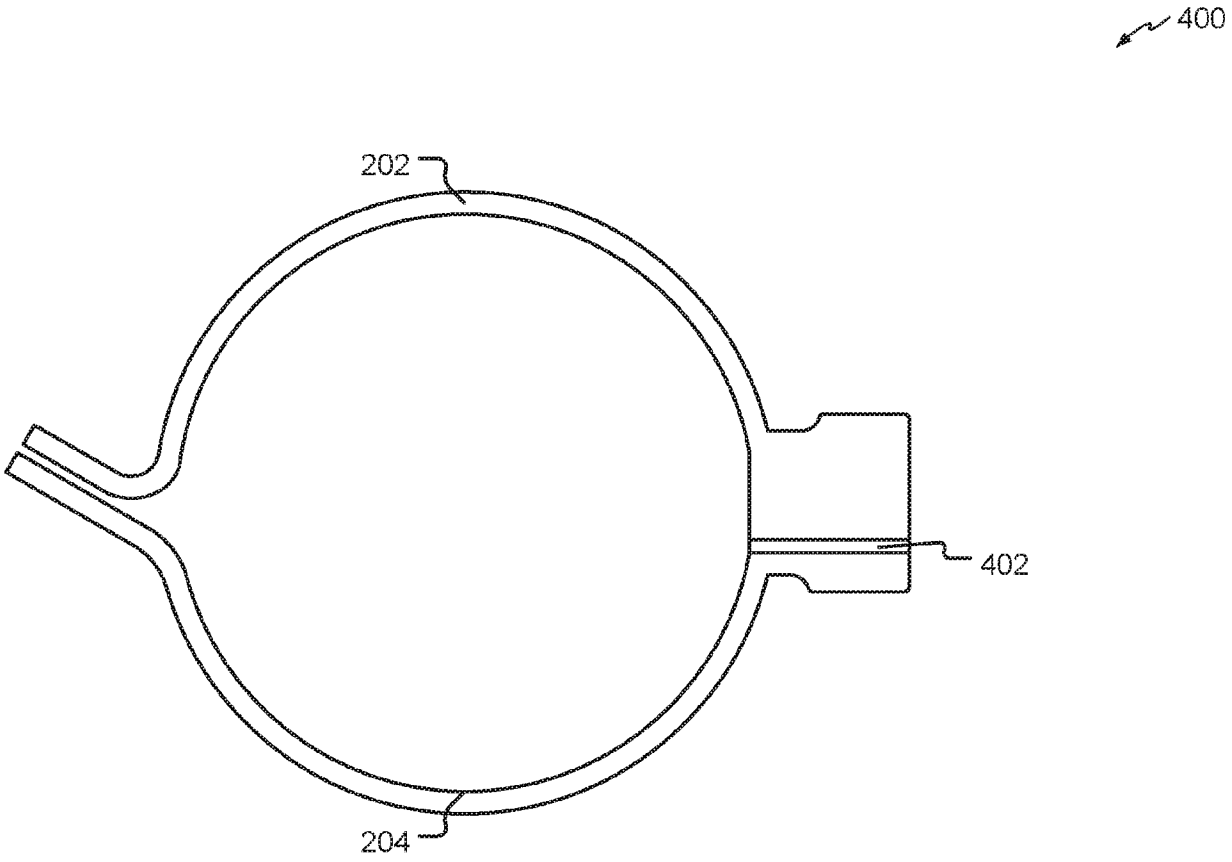
FIG. 4 is a cross-sectional view of the suspension element shown in FIG. 2 and a spacer.

FIG. 3 depicts a cross-sectional view 300 of the suspension element 200 of FIG. 2 without a spacer. The cross-sectional view 300 illustrates an opening defined by the first surround element 202 and the second surround element 204. FIG. 4 depicts a cross-sectional view 400 of the suspension element 200 of FIG. 2 with a spacer 402 disposed between the first surround element 202 of FIG. 2 and the second surround element 204 of FIG. 2. The spacer 402 includes thin, stiffening, or joining piece that serves as an intermediary between the first surround element 202 of FIG. 2 and the second surround element 204 of FIG. 2. The spacer 402 may include one or more pieces disposed across and between the first surround element 202 of FIG. 2 and the second surround element 204 of FIG. 2. Alternatively, the spacer 402 may be disposed between contacting parts of the surround elements 202, 204 of FIG. 2.

The spacer 402 is made of a material from at least one of plastic, rubber, foam, fabric, or metal. In some implementations, the spacer 402 may be made from a porous material. In other implementations, the spacer 402 may be made from a non-porous material. The spacer 402 is coupled or bonded using any suitable method (e.g., via an adhesive or by melting the material of the suspension element to the spacer, among others).

Figure 5:
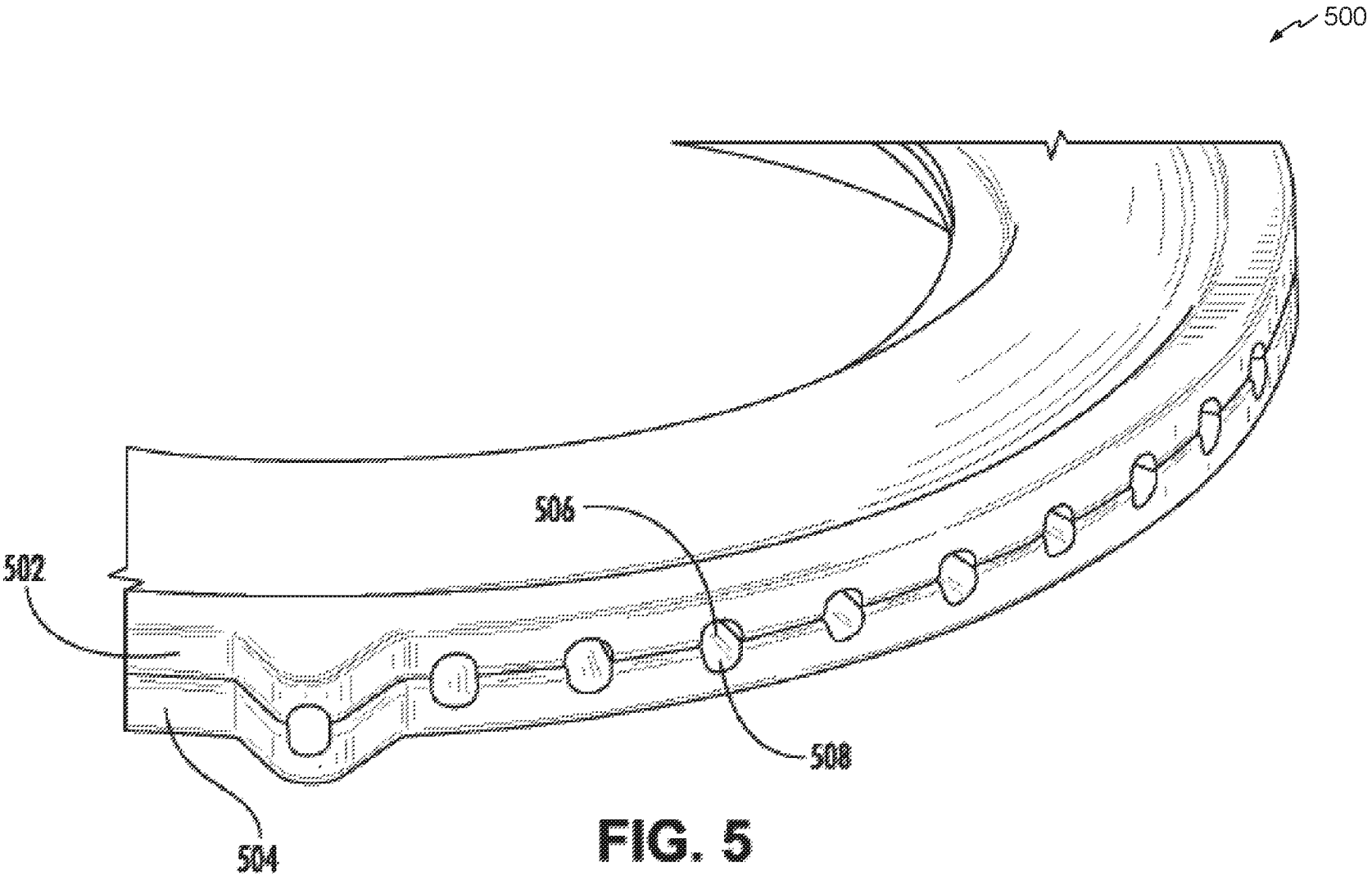
FIG. 5 is a sectional view of another exemplary implementation of a suspension element including a first surround element and a second surround element with aligned openings for venting.

FIG. 5 depicts a sectional view of another exemplary implementation of a suspension element 500 having a first surround element and a second surround element that define an interior chamber and openings for ventilating the interior chamber. The suspension element 500 may be the suspension element 104 of FIG. 1 or the suspension element 200 of FIG. 2. The suspension element 500 includes a first surround element 502 and a second surround element 504. At least one of the surround elements 502, 504 is made of a material from at least one of fabric, rubber, foam, metal, polymer, polyurethane plastic, such as thermoplastic polyurethane, or a composite thereof. The surround elements 502, 504 may include or correspond to the surround elements 202, 204 of FIG. 2.

The first surround element 502 includes one or more openings 506 (e.g., one or more features, such as one or more grooves) that are located at an edge of the first surround element 502. The second surround element 504 includes one or more openings 508 (e.g., one or more features, such as one or more grooves) that are located at an edge of the second surround element 504. The openings 506, 508 are configured to vent an interior of the surround elements 502, 504 with an exterior of the surround elements 502, 504. The one or more openings 506 are formed into the surround element 502. The one or more openings 508 are formed into the surround element 504.

As shown in FIG. 5, the openings 506 of the first surround element 502 are aligned with the openings 508 of the second surround element 504. For example, while the first surround element 502 is coupled to the second surround element 504, the first surround element 502 and the second surround element 504 define at least one opening (corresponding to an opening 506 and an opening 508). According to another implementation, the openings 506 of the first surround element 502 are offset relative to the openings 508 of the second surround element 504. As another example, while the first surround element 502 is coupled to the second surround element 504, the first surround element 502 and the second surround element 504 define a first opening (corresponding to an opening 506) and define a second opening (corresponding to an opening 508).

According to a particular example, the openings 506, 508 are based on a particular acoustic impedance of the suspension element 500. In an implementation, the openings 506, 508 are based on a particular resonance effect of an acoustic device. The acoustic device may correspond to the acoustic device 100 of FIG. 1. The acoustic impedance or the resonance effect is based on a size of the openings 506, 508. In one aspect, the size of the openings is based on an area of the openings 506, 508 in relation to an area of the suspension element 500. The area of the suspension element 500 may be a surface area of the suspension element 500.

Figure 6:
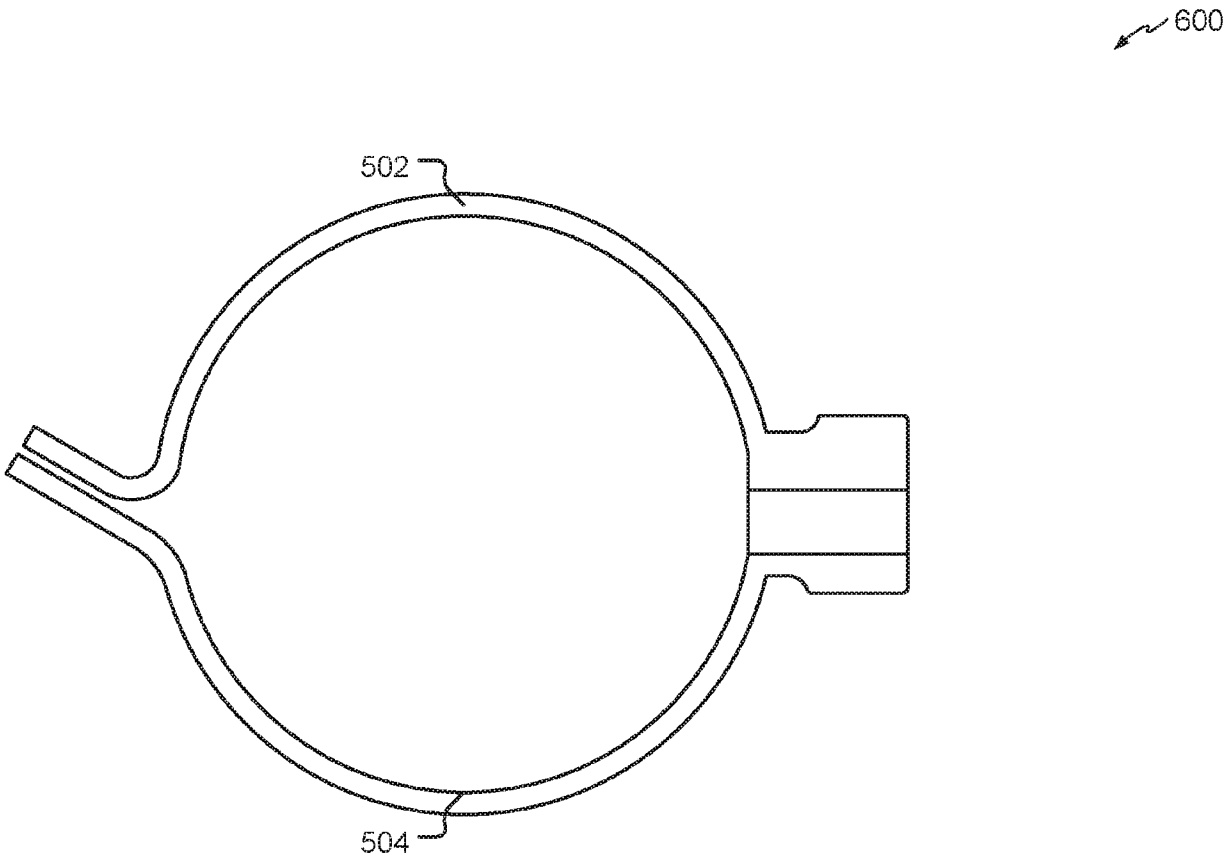
FIG. 6 is a cross-sectional view of the suspension element shown in FIG. 5 with both surround elements including openings for venting.
Figure 7:
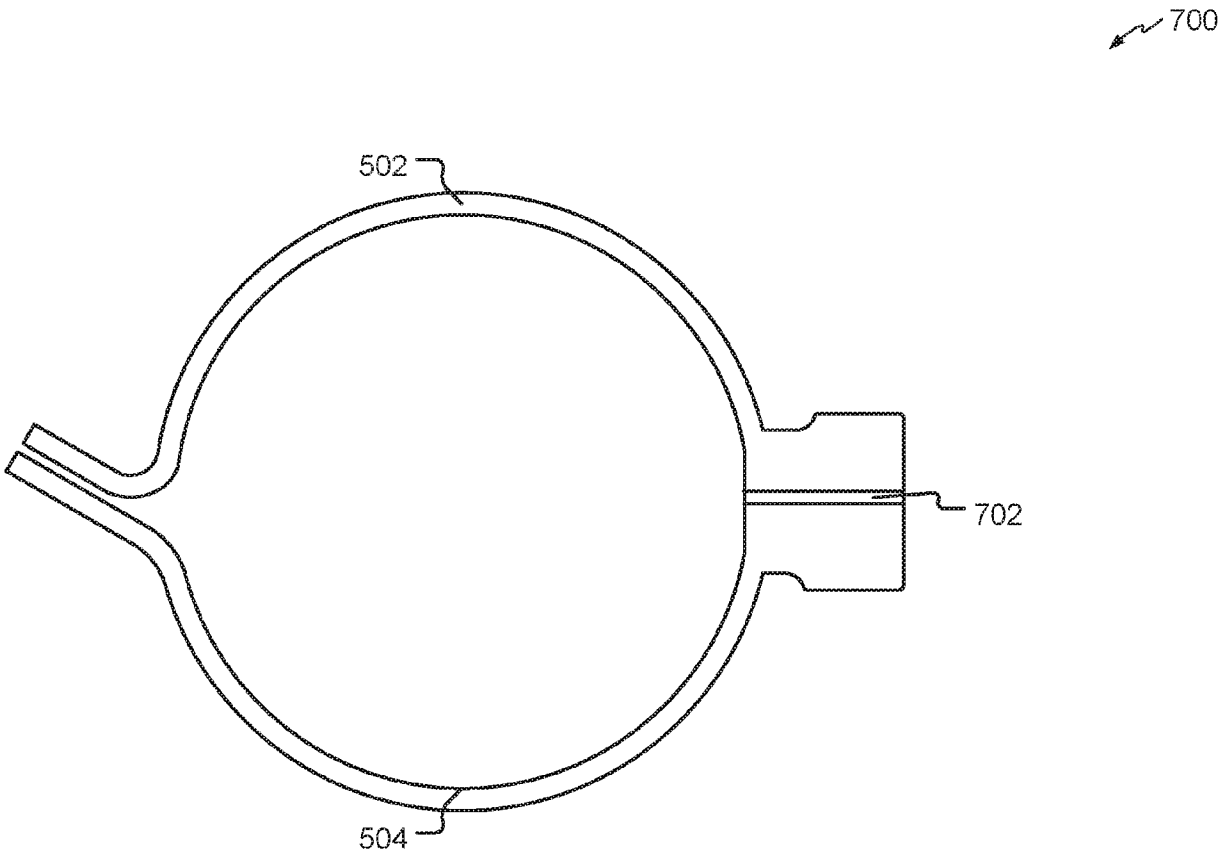
FIG. 7 is a cross-sectional view of the suspension element shown in FIG. 5 with both surround elements including openings for venting and a spacer in between the surround elements.

FIG. 6 depicts a cross-sectional view 600 of the suspension element 500 of FIG. 5 without a spacer. The cross-sectional view 600 illustrates an opening defined by the first surround element 502 and the second surround element 504. FIG. 7 is a cross-sectional view 700 of the suspension element 500 of FIG. 5 with a spacer 702 disposed between the first surround element 502 of FIG. 5 and the second surround element 504 of FIG. 5. The spacer 702 includes a stiffening, or joining piece that serves as an intermediary between the first surround element 502 of FIG. 5 and the second surround element 504 of FIG. 5. The spacer 702 may be disposed between contacting parts of the surround elements 502, 504 of FIG. 5.

The spacer 702 is made of a material from at least one of plastic, rubber, foam, fabric, or metal. The spacer 702 may be made from a porous material. Alternatively, the spacer 702 may be made from a non-porous material. The spacer 702 is coupled or bonded using any suitable method (e.g., via an adhesive or by melting the material of the suspension element to the spacer, among others).

Figure 8:
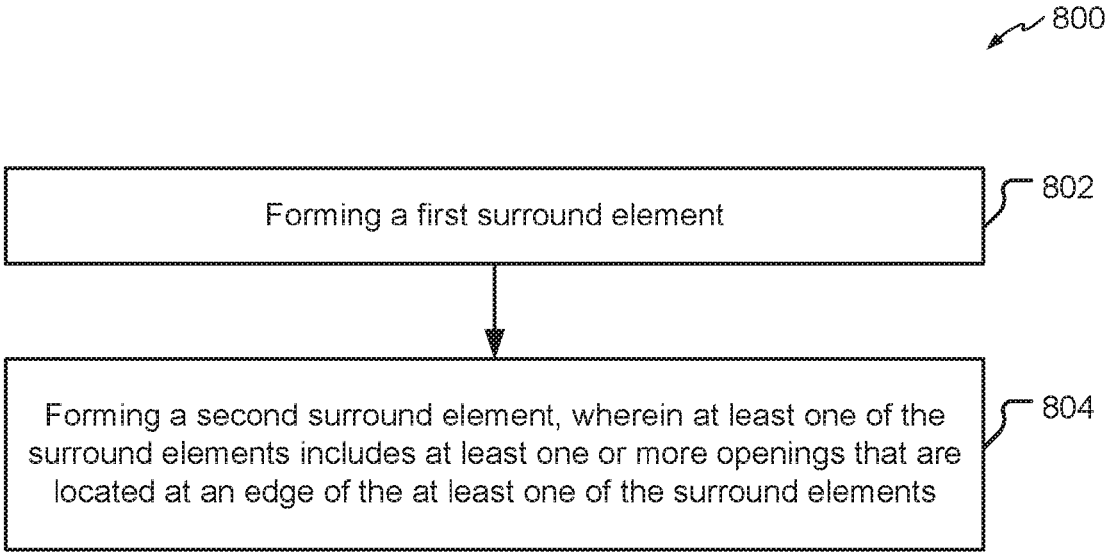
FIG. 8 is a flowchart that illustrates a particular implementation of a method for forming a suspension element.

FIG. 8 depicts a flowchart diagram representing a particular example of a method 800 for forming a suspension element. The suspension element may be the suspension element 104 of FIG. 1. According to a particular implementation, the suspension element may be the suspension element 200 of FIG. 2. According to another particular implementation, the suspension element may be the suspension element 500 of FIG. 5.

The method 800 includes, at 802, forming a first surround element. According to an implementation, the first surround element may be the first surround element 202 of FIG. 2. According to another implementation, the first surround element may be the first surround element 502 of FIG. 5. The first surround element may be formed via compression molding, injection molding, or thermal forming.

The method 800 also includes, at 804, forming a second surround element. At least one of the surround elements includes at least one or more openings (e.g., features or grooves) that are located at an edge of the at least one of the surround elements. According to an implementation, the second surround element may be the second surround element 204 of FIG. 2. According to another implementation, the second surround element may be the second surround element 504 of FIG. 5. The second surround element may be formed via compression molding, injection molding, or thermal forming.

In one aspect, forming the at least one of the surround elements is based on at least one of a particular acoustic impedance of the at least one of the surround elements adjacent to the other surround element or a particular resonance effect of an acoustic device. In an implementation, the at least one of the particular acoustic impedance or the particular resonance effect is based on a size of the at least one or more openings. According to a particular implementation, the one or more openings may correspond to the one or more openings 206 of FIG. 2. According to another particular implementation, the one or more openings may correspond to the one or more openings 506, 508 of FIG. 5. The size of the at least one or more openings is based on an area of the at least one or more openings in relation to (e.g., as a percentage of) an area of the surround elements. According to an implementation, the surround elements may be the surround elements 202, 204 of FIG. 2. According to another implementation, the surround elements may be the surround elements 502, 504 of FIG. 5.

According to an implementation, the first surround element includes at least one or more openings that are located at an edge of the at least one of the surround elements. The first surround element may be the first surround element 202 of FIG. 2. According to another implementation, both of the surround elements include at least one or more openings (e.g., one or more features, such as grooves, channels, etc.). According to a particular implementation, the at least one or more openings are located at edges of the surround elements. The surround elements may be the surround elements 502, 504 of FIG. 5.

In another aspect, the method 800 may include coupling the first surround element with the second surround element. In an example, the coupling may be illustrated by the cross-sectional view 300 of FIG. 3. In another example, the coupling may be illustrated by the cross-sectional view 600 of FIG. 6. According to a particular implementation, the coupling of the first surround element with the second surround element includes coupling a spacer between the first surround element and the second surround element. In an example, the coupling may be illustrated by the cross-sectional view 400 of FIG. 4. In another example, the coupling may be illustrated by the cross-sectional view 700 of FIG. 7.

According to an implementation, the coupling of the first surround element with the second surround element includes aligning the at least one or more openings of the first surround element with the at least one or more openings of the second surround element. In an example, the aligning of the at least one or more openings is illustrated by the suspension element 500 of FIG. 5. According to another implementation, the coupling of the first surround element with the second surround element includes offsetting the at least one or more openings of the first surround element relative to the at least one or more openings of the second surround element. In another aspect, the method 800 may include compressing the first surround element to achieve a less porous material.

As with the above described flowchart and all examples disclosed herein, those skilled in the art may make numerous uses and modifications of and departures from the specific apparatus and disclosed techniques without departing from the overall concepts. For example, selected implementations of a suspension element in accordance with the present disclosure may include all, fewer, or different components than those described with reference to one or more of the preceding figures. Spacers and vent through-hole tangency may be present or selectively absent from implementations. The disclosed examples should be construed as embracing each and every novel feature and novel combination of features present in or possessed by the apparatus and techniques disclosed herein and limited only by the scope of the appended claims, and equivalents thereof.

The invention claimed is:

1. An acoustic device comprising:

a frame;

a diaphragm; and a suspension element that couples the diaphragm to the frame such that the diaphragm is movable in a reciprocating manner relative to the frame, the suspension element comprising a first surround element and a second surround element that are located adjacent to each other, wherein one or both surround elements include at least one opening, the at least one opening being located at an edge of one of the surround elements adjacent to the other surround element, and wherein a number or placement of the at least one opening corresponds to at least one of a particular acoustic impedance of the suspension element or a particular resonance effect of the acoustic device.

2. The acoustic device of claim 1, further comprising a spacer disposed between the first surround element and the second surround element.

3. The acoustic device of claim 2, wherein the spacer is disposed between the first surround element and the second surround element, and wherein the at least one opening is configured to vent an interior of the surround elements with an exterior of the surround elements.

4. The acoustic device of claim 1, wherein the particular acoustic impedance or the particular resonance effect is based on a size of the at least one opening.

5. The acoustic device of claim 1, wherein the size of the at least one opening is based on an area of the at least one opening relative to an area of the suspension element.

6. The acoustic device of claim 1, wherein the first surround element includes a first opening proximate an edge surface of the first surround element, and the second surround element includes a second opening proximate an edge surface of the second surround element.

7. The acoustic device of claim 6, wherein the first and second openings are substantially aligned with one another.

8. The acoustic device of claim 7, wherein the first and second openings are offset relative to one another, and further comprising a transducer that includes the frame, the diaphragm, and the suspension element.

9. The acoustic device of claim 1, wherein at least one of the first surround element, the second surround element, and a spacer comprises porous material.

* * * * *